343-700 MS AU 251 EX
7/23/85 XR 4,531,130

United States Patent [19]

Powers et al.

[11] Patent Number: 4,531,130

[45] Date of Patent: Jul. 23, 1985

[54] CROSSED TEE-FED SLOT ANTENNA

[75] Inventors: Richard L. Powers; Kenneth D. Arkind, both of Nashua, N.H.

[73] Assignee: Sanders Associates, Inc., Nashua, N.H.

[21] Appl. No.: 504,567

[22] Filed: Jun. 15, 1983

[51] Int. Cl.[3] ..... H01Q 1/38; H01Q 13/18

[52] U.S. Cl. ..... 343/767; 343/700 MS

[58] Field of Search ..... 343/767-771, 343/700 MS, 829, 830, 846, 705, 708, 789; 333/238, 246

[56] References Cited

U.S. PATENT DOCUMENTS

| | | | |
|---|---|---|---|
| 2,586,895 | 2/1952 | Willoughby | 343/770 |
| 2,636,987 | 4/1953 | Dorne | 343/708 |
| 2,982,960 | 5/1961 | Shanks | 343/771 |
| 3,653,052 | 3/1972 | Campbell et al. | 343/708 |
| 3,665,480 | 5/1972 | Fassett | 343/700 MS |
| 3,971,032 | 7/1976 | Munson et al. | 343/770 |
| 4,017,864 | 4/1977 | Proctor | 343/767 |
| 4,021,813 | 5/1977 | Black et al. | 343/768 |
| 4,197,544 | 4/1980 | Kaloi | 343/767 |
| 4,197,545 | 4/1980 | Favaloro et al. | 343/767 |
| 4,242,685 | 12/1980 | Sanford | 343/770 |
| 4,326,203 | 4/1982 | Kaloi | 343/700 MS |
| 4,443,802 | 4/1984 | Mayes | 343/767 |

FOREIGN PATENT DOCUMENTS

| | | | |
|---|---|---|---|
| 128903 | 10/1980 | Japan | 343/770 |

*Primary Examiner*—Eli Lieberman
*Assistant Examiner*—Michael C. Wimer
*Attorney, Agent, or Firm*—Louis Etlinger; Stanton D. Weinstein

[57] ABSTRACT

A microwave antenna is made of a pair of parallel ground-plane conductors (12 and 14), one of which forms a generally cruciform aperture (18). A pair of T-shaped feedlines are disposed with their cross pieces (22 and 34) in registration with the respective arms (20 and 36) of the aperture 18 and are independently driven from stems (26 and 32) disposed between the ground-plane conductors.

21 Claims, 2 Drawing Figures

CROSSED TEE-FED SLOT ANTENNA

BACKGROUND OF THE INVENTION

The present invention is directed to microwave antennas, particularly antennas of the type whose planes of polarization can be varied.

A microwave antenna described in U.S. Pat. No. 4,197,545 to Favaloro et al., hereby incorporated by reference, is of the stripline type, which is a type particularly well suited to aircraft applications. Despite its stripline configuration, it has a broad bandwidth that had previously been obtainable only in bulky waveguide devices.

It is an object of the present invention to employ the Favaloro et al. teachings in a variable-polarization antenna without eliminating those features that give it its broad bandwidth.

SUMMARY OF THE INVENTION

The foregoing and related objects are achieved in a stripline antenna in which one of the ground-plane conductors has a generally cruciform aperture with first and second aperture arms. Shorting elements extending between the ground-plane conductors surround the aperture to form a cavity defined by the ground-plane conductors and the shorting elements.

The stem of a generally T-shaped feed conductor extends between and generally parallel to the ground-plane conductors and into the cavity. It extends in the same direction as the second aperture arm does but is out of registration with it. The cross piece of the feed conductor is disposed in the cavity in registration with one of the arms of the cruciform aperture. The ends of the cross piece are connected to the ground planes.

Another T-shaped feed conductor is provided, this one oriented perpendicular to the first. Its stem is generally parallel to the ground-plane conductors, extending into the cavity in the same direction as the first aperture arm but disposed out of registration with it. Its cross piece is disposed in the cavity in registration with the second arm of the cruciform aperture. Consequently, the stem of one feed conductor is spaced from the cross piece of the other.

By means of this arrangement, two orthogonally oriented Favaloro-type elements share the same cavity but are so spaced as substantially to prevent interaction between the feed conductor of one element and the aperture arm of the other. Thus, the feed conductors readily provide variably polarized radiation patterns when they are driven independently.

BRIEF DESCRIPTION OF THE DRAWINGS

These and further features and advantages of the present invention are described in more detail in connection with the accompanying drawings, in which.

DETAILED DESCRIPTION OF THE PREFERRED EMBODIMENT

Figure 1:
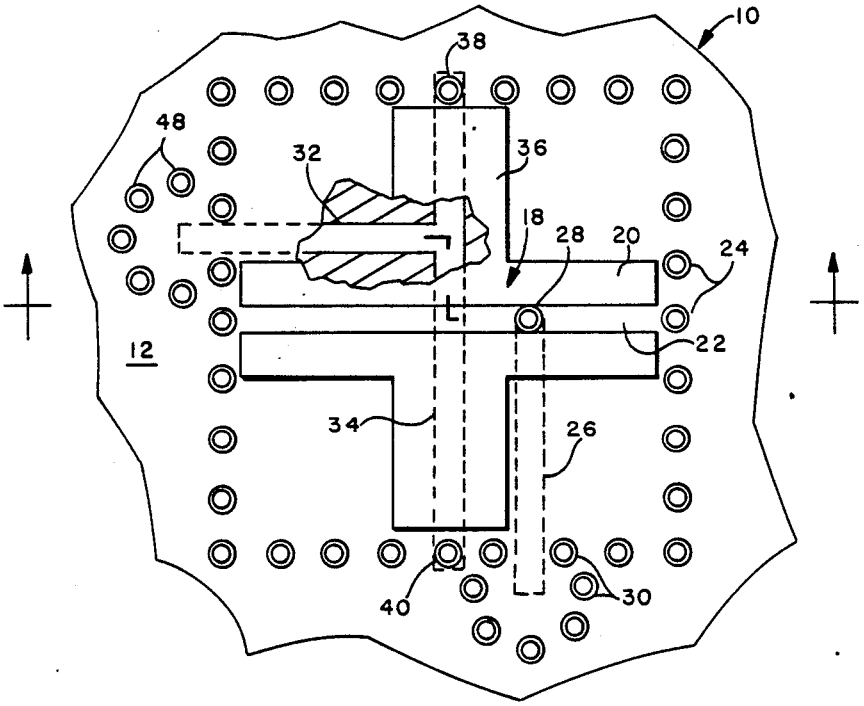
FIG. 1 is a plan view, partially broken away, of a microwave antenna constructed in accordance with the teachings of the present invention.
Figure 2:
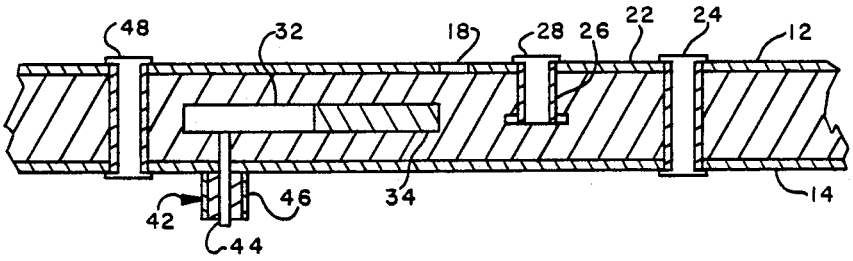
FIG. 2 is a sectional view taken at line 2—2 of FIG. 1.

The antenna 10 depicted in FIGS. 1 and 2 includes a pair of generally planar copper ground-plane conductors 12 and 14 separated by layer 16 of a dielectric material. The dielectric layer is shown in FIG. 2 as being of a single piece, although those skilled in the art will recognize that stripline antennas are ordinarily constructed of two dielectric layers to permit disposition of inner conductors between the ground planes.

The upper ground-plane conductor 12 has an aperture 18 etched in it. The aperture 18 is generally cruciform but one of the aperture arms 20 is bisected lengthwise by a narrow copper cross piece 22 that is a continuation of the upper ground plane 12 and is thus connected to it at its ends. It will become apparent as the description proceeds that the cross piece 22 need not be provided as a part of the upper ground plane 12, but we believe that such an arrangement is desirable because it is easy to fabricate.

Shorting elements in the form of conducting eyelets 24 surround the aperture 18 to interconnect the ground-plane conductors 12 and 14 together and form a cavity defined by the eyelets 24 and the ground planes 12 and 14. The distance across the cavity in the directions of the aperture arms should be between one-half and one wavelength at the frequencies at which the antenna is to operate. Conductive screws, plated-through holes, and other types of shorting elements can, of course, be used in place of the eyelets. The purpose of the cavity is the same as that of the cavity described in the Favaloro et al. patent.

Cross piece 22 forms the end of a generally T-shaped feed line that includes a stem portion 26 extending between and generally parallel to the upper and lower ground-plane conductors 12 and 14. Stem 26 extends from a coaxial connector (not shown) into the cavity, where it is electrically connected to cross piece 22 by a conducting eyelet 28 that extends vertically from stem 26 to cross piece 22.

A series of eyelets 30 (seven in FIG. 1) forms a shield around the position in which the coaxial connector joins stem 26, and they leave an entryway by which the stem 26 extends into the cavity.

A second generally T-shaped feed line includes a stem 32 also disposed between the ground planes 12 and 14. Stem 32 meets a second cross piece 34, which, unlike cross piece 22, is disposed between the upper and lower ground-plane conductors 12 and 14. Cross piece 34 is located in registration with the other arm 36 of the cruciform aperture 18 and is connected at its ends to the ground-plane conductors 12 and 14 by conducting eyelets 38 and 40 extending between the ground planes 12 and 14 and through the ends of cross piece 34.

In the illustrated embodiment, a coaxial connector 42 located laterally just outside the cavity provides the means by which stem 32 is driven. The center conductor 44 of the connector 42 is connected to stem 32, while the outer conductor 46 is connected to the lower ground plane 14. Eyelets 48 similar to eyelets 30 form a shield around the connector 42 and leave an opening by which the stem 32 enters the cavity.

The drive signals in the illustrated embodiment are introduced by coaxial lines immediately adjacent to the cavity. However, the ground planes of some antennas will often serve as ground planes for stripline feed paths or for several other antennas in an array. Many embodiments of the present invention, therefore, will not have shields such as those that include eyelets 30 and 48. Stems 26 and 32 in such arrangements will be continuations of long TEM-mode stripline center conductors that enter the cavity through gaps left for that purpose in the cavity walls defined by the shorting elements 24.

An antenna of the type shown in the drawings has achieved a bandwidth of thirty percent of its center frequency, bandwidth in this case being the range of frequencies for which the VSWR of the antenna was less than 2.0.

The length and width of the cavity were three-quarters of a wavelength at the center frequency. The lengths of the arms 20 and 36 of the aperture 18 were 0.65 wavelength, while the widths of the arms 20 and 36 were 0.1 wavelength. The separation of the ground-plane conductors 12 and 14 was also 0.1 wavelength, and the stems 22 and 32 of the feedlines were disposed halfway between the ground-plane conductors. The thicknesses of the ground-plane conductors and the feedlines were 0.0014", while the widths of the feedlines were 0.100". The dielectric material 16 was fiberglass-reinforced polytetrafluorethylene.

In operation, the stems 26 and 32 of the T-shaped feedlines are driven independently of each other. The plane of polarization then is dependent upon the relative amplitudes of the signals on the feedlines. If elliptical polarization is desired, the feedlines are driven out of phase.

If stem 26 is driven without any signal on stem 32, the electric-field plane in the transmitted radiation is parallel to stem 26. The electric field that results when only stem 32 is driven is parallel to stem 32. If both are driven in phase (or 180° out of phase), the angle of the plane of polarization is the arctangent of the ratio of the amplitudes of the signals on the feed lines.

Of course, the teachings of the present invention can be practiced with antennas varying somewhat from the antenna specifically disclosed in the foregoing discussion. For example, there is no requirement that one of the cross pieces be coplanar with one of the ground-plane conductors. Also, although we prefer to use a square cavity, other rectangular shapes, or even circular shapes, can be employed.

Furthermore, with regard to the spacing of the ground-plane conductors 12 and 14, we prefer that it be less than one-quarter of a wavelength so that it can readily be incorporated in a stripline-fed array, but greater spacings are possible in principle.

It is thus apparent that the advantage of broad-band operation can be achieved in variable-polarization antennas if the teachings of the present invention are followed.

We claim:

1. A variable-polarization microwave antenna for reception and transmission of microwaves within a predetermined range of frequencies, said antenna comprising:

A. first and second generally planar ground-plane conductors spaced apart and extending generally parallel to each other, said first conductor forming a generally cruciform aperture having first and second arms extending transversely of each other;

B. shorting elements extending between said ground-plane conductors to short them together and surrounding said aperture to form a cavity defined by said ground-plane conductors and said shorting elements, the distances across said cavity in the directions of said aperture arms being between one-half and one wavelength at frequencies within the predetermined frequency range;

C. a first feed line including a first generally tee-shaped feed conductor whose stem extends between and generally parallel to said ground-plane conductors and into said cavity out of registration with said second aperture arm, the crosspiece of said first feed conductor being disposed in said cavity in registration with said first aperture arm and shorted to said ground planes at its ends; and D. a second feed line including a second generally tee-shaped feed conductor whose stem extends between and generally parallel to said ground-plane conductors and into said cavity out of registration with said first aperture arm, the crosspiece of said second feed conductor being disposed in said cavity in registration with said second aperture arm and shorted to said ground planes at its ends, said first and second feed lines being independently driveable for variation of the plane of polarization by variation of the amplitude ratio of the drive signals on said first and second feed lines.

2. A microwave antenna as recited in claim 1 wherein said cavity has a substantially rectangular periphery defined by said shorting elements.

3. A microwave antenna as recited in claim 2 wherein said ground-plane conductors are spaced apart by less than one-quarter wavelength at frequencies within the predetermined frequency range.

4. A microwave antenna as recited in claim 1 wherein said ground-plane conductors are spaced apart by less than one-quarter wavelength at frequencies within the predetermined frequency range.

5. A microwave antenna as recited in claim 1 wherein said crosspiece of said first feed conductor is substantially coplanar with said first ground-plane conductor.

6. A microwave antenna as recited in claim 1 wherein said first and second ground-plane conductors are spaced apart by substantially one-tenth wavelength at a frequency within the predetermined range of frequencies.

7. A microwave antenna as recited in claim 1 wherein:

the length of said first arm is substantially 0.65 wavelength at a frequency within the predetermined range of frequencies;

the length of said second arm is substantially 0.65 wavelength at a frequency within the predetermined range of frequencies;

the width of said first arm is substantially 0.1 wavelength at a frequency within the predetermined range of frequencies; and the width of said second arm is substantially 0.1 wavelength at a frequency within the predetermined range of frequencies.

8. A microwave antenna as recited in claim 1 further comprising dielectric material disposed between said first and second ground-plane conductors.

9. A microwave antenna as recited in claim 1 further comprising:

a connector disposed on a ground-plane conductor and connected to a feed line; and shorting elements extending between said first and second ground-plane conductors about said connector.

10. A microwave antenna as recited in claim 1, further comprising;

a first connector connected to said first feed line; and a second connector connected to said second feed line.

11. A microwave antenna as recited in claim 10, wherein:

said first connector is connected to said stem of said first feed conductor;

said second connector is connected to said stem of said second feed conductor; and said microwave antenna further comprises shorting elements extending between said first and second ground-plane conductors about said first connector and about said second connector.

12. A microwave antenna as recited in claim 1 wherein said cavity has a substantially square periphery defined by said shorting elements.

13. A microwave antenna as recited in claim 12 wherein the length of one side of said cavity is substantially three-quarters of a wavelength at a frequency within the predetermined range of frequencies.

14. A microwave antenna as recited in claim 13 wherein:

the length of said first arm is substantially 0.65 wavelength at a frequency within the predetermined range of frequencies;

the length of said second arm is substantially 0.65 wavelength at a frequency within the predetermined range of frequencies;

the width of said first arm is substantially 0.1 wavelength at a frequency within the predetermined range of frequencies; and the width of said second arm is substantially 0.1 wavelength at a frequency within the predetermined range of frequencies.

15. A microwave antenna as recited in claim 4 wherein said cavity has a substantially square periphery defined by said shorting elements.

16. A microwave antenna as recited in claim 15 wherein the length of one side of said cavity is substantially three-quarters of a wavelength at a frequency within the predetermined range of frequencies.

17. A microwave antenna as recited in claim 2 wherein said crosspiece of said first feed conductor is substantially coplanar with said first ground-plane conductor.

18. A microwave antenna as recited in claim 2 wherein said ground-plane conductors are spaced apart by substantially one-tenth wavelength at a frequency within the predetermined range of frequencies.

19. A microwave antenna as recited in claim 2 further comprising:

a connector diposed on a ground-plane conductor and connected to a feed line; and shorting elements extending between said first and second ground-plane conductors about said connector.

20. A microwave antenna as recited in claim 2, further comprising:

a first connector connected to said first feed line; and a second connector connected to said second feed line.

21. A microwave antenna as recited in claim 20 wherein:

said first connector is connected to said stem of said first feed conductor;

said second connector is connected to said stem of said second feed conductor; and said microwave antenna further comprises shorting elements extending between said first and second ground-plane conductors about said first connector and about said second connector.

* * * * *